US010415508B2

(12) United States Patent
Schmidt

(10) Patent No.: US 10,415,508 B2
(45) Date of Patent: Sep. 17, 2019

(54) CHARGE FORMING DEVICE WITH AIR BLEED CONTROL VALVE

(71) Applicant: Walbro LLC, Tucson, AZ (US)

(72) Inventor: Thomas L. Schmidt, Cass City, MI (US)

(73) Assignee: Walbro LLC, Tucson, AZ (US)

( * ) Notice: Subject to any disclaimer, the term of this patent is extended or adjusted under 35 U.S.C. 154(b) by 0 days.

(21) Appl. No.: 15/763,358

(22) PCT Filed: Oct. 7, 2016

(86) PCT No.: PCT/US2016/055955
§ 371 (c)(1),
(2) Date: Mar. 26, 2018

(87) PCT Pub. No.: WO2017/062746
PCT Pub. Date: Apr. 13, 2017

(65) Prior Publication Data

US 2018/0291842 A1 Oct. 11, 2018

Related U.S. Application Data

(60) Provisional application No. 62/239,486, filed on Oct. 9, 2015.

(51) Int. Cl.
*F02M 7/26* (2006.01)
*F02M 9/08* (2006.01)
*F02M 17/04* (2006.01)

(52) U.S. Cl.
CPC ..... *F02M 7/26* (2013.01); *F02M 9/08* (2013.01); *F02M 17/04* (2013.01)

(58) Field of Classification Search
CPC ..... F02M 7/24; F02M 21/0239; F02M 7/26; F02M 11/02; F02M 1/046; F02M 1/00;
(Continued)

(56) References Cited

U.S. PATENT DOCUMENTS 1,672,923 A 6/1928 Zarracina
1,944,309 A 1/1934 Vogel
(Continued)

FOREIGN PATENT DOCUMENTS

GB 293935 A 7/1928
GB 1477421 A 6/1977
(Continued)

OTHER PUBLICATIONS

Written Opinion & International Search Report for PCT/US2016/055955 dated Dec. 14, 2016, 14 pages.
(Continued)

*Primary Examiner* — Long T Tran
(74) *Attorney, Agent, or Firm* — Reising Ethington P.C.

(57) ABSTRACT

In at least some implementations, a charge forming device includes a body defining at least part of a first passage, a throttle valve movable relative to the first passage between an idle position and a wide open position, an air bleed passage communicated with the first passage, and a control valve. The control valve may be arranged in the air bleed passage to selectively inhibit or prevent air flow to the first passage from the air bleed passage. And the control valve is moveable between a first position and a second position in response to movement of the throttle valve wherein greater air flow is permitted from the air bleed passage to the first passage in the body when the control valve is in the second position than when the control valve is in the first position.

18 Claims, 6 Drawing Sheets

(58) Field of Classification Search
CPC ..... F02M 3/045; F02D 35/0053; F02D 2200/0404; F02D 9/1055
See application file for complete search history.

(56) References Cited

U.S. PATENT DOCUMENTS

| | | | | |
|---|---|---|---|---|
| 2,208,317 | A | 7/1940 | Beck | |
| 4,208,361 | A * | 6/1980 | Ushijima | F02M 7/26 137/625.48 |
| 4,377,539 | A * | 3/1983 | Irish | F02M 7/24 261/121.4 |
| 4,838,229 | A * | 6/1989 | Uranishi | F02D 35/0061 123/520 |
| 4,841,940 | A * | 6/1989 | Uranishi | F02D 35/0076 123/694 |
| 5,377,650 | A * | 1/1995 | Warner | F01N 3/22 123/568.29 |
| 6,349,925 | B1 | 2/2002 | Tobinai et al. | |
| 7,287,743 | B1 * | 10/2007 | Gliniecki | F02M 1/046 261/121.3 |
| 2003/0015808 | A1 * | 1/2003 | Burns | F02M 1/04 261/63 |
| 2004/0017014 | A1 | 1/2004 | Tobinai | |
| 2004/0232569 | A1 | 11/2004 | Nonaka | |
| 2016/0090942 | A1 * | 3/2016 | Kaneda | F02M 7/26 261/44.6 |

FOREIGN PATENT DOCUMENTS

| | | | |
|---|---|---|---|
| JP | S56159543 | A | 12/1981 |
| JP | S60195365 | A | 10/1985 |
| JP | H1182174 | A | 3/1999 |
| JP | 2007177758 | A | 7/2007 |
| KR | 1020070020776 | A | 2/2007 |

OTHER PUBLICATIONS

SE Office Action for SE Application No. 1850384-7 dated Apr. 29, 2019 (11 pages).

* cited by examiner

CHARGE FORMING DEVICE WITH AIR BLEED CONTROL VALVE

REFERENCE TO RELATED APPLICATION

This patent application claims the benefit of the earlier filed U.S. provisional patent application, Ser. No. 62/239,486, filed on Oct. 9, 2015, which is incorporated herein in its entirety by reference.

TECHNICAL FIELD

The present disclosure relates generally to charge forming devices, such as carburetors, that participate in providing a fuel and air mixture to an engine.

BACKGROUND

A carburetor is used to provide a combustible charge or mixture of fuel and air to an internal combustion engine. The carburetor meters liquid fuel for mixing with air to adjust a fuel-to-air ratio, according to varying engine requirements during engine startup, idle, steady-state operation, and changes in load and altitude.

A diaphragm-type carburetor is typically used with small two-stroke internal combustion engines commonly used in hand-held power tools such as chain saws, weed trimmers, leaf blowers, and the like. In the diaphragm carburetor, a body defines a mixing passage with an air inlet and a downstream fuel-and-air mixture outlet. A throttle valve is disposed in the fuel-and-air mixing passage downstream of the air inlet for controlling delivery of a primary fuel-and-air mixture to the engine.

SUMMARY

In at least some implementations, a charge forming device includes a body defining at least part of a first passage through which fuel or air or both flows for delivery to an engine, a throttle valve movable relative to the first passage between an idle position and a wide open position, an air bleed passage communicated with the first passage to provide a supply of air to the first passage, and a control valve. The control valve may be arranged in the air bleed passage to selectively inhibit or prevent air flow to the first passage from the air bleed passage. And the control valve is moveable between a first position and a second position in response to movement of the throttle valve wherein greater air flow is permitted from the air bleed passage to the first passage in the body when the control valve is in the second position than when the control valve is in the first position.

In at least some implementations, one or more of the following features are provided individually or in any combination. The control valve may be driven by the throttle valve between its first and second positions. The control valve may be in the first position when the throttle valve is in the idle position and until the throttle valve is moved a threshold amount toward the wide open position, and the threshold amount may be between 30% and 90%. A valve seat against which the control valve is engaged in the first position may be provided, and the throttle valve may include a cam portion that has a distance from the valve seat that varies as the throttle valve is moved between the idle position and wide open position. The throttle valve may be rotatable about an axis between the idle position and wide open position, and the throttle valve may include a drive surface that is not circular relative to the axis and the drive surface causes movement of the control valve between the first and second positions as the throttle valve is rotated. A lost motion coupling may be provided between the throttle valve and the control valve so that some rotation of the throttle valve occurs without a corresponding movement of the control valve.

In at least some implementations, the first passage is a fuel and air mixing passage through which a fuel and air mixture is discharged for delivery to an engine, the body includes a valve shaft bore that intersects the fuel and air mixing passage and the throttle valve includes a throttle valve shaft received for rotation about the axis within the valve shaft bore and a throttle valve head carried by the throttle valve shaft and the drive surface is carried by or formed on the throttle valve shaft. Part of the air bleed passage may intersect the valve shaft bore and the control valve may be received within said part of the air bleed passage. The control valve may include a follower and a valve body that are received in said part of the air bleed passage that intersects the valve shaft bore, the follower being engaged by and moved within the air bleed passage by the drive surface during a portion of the rotation of the throttle valve shaft and the follower engaging the valve body during at least a portion of the movement of the follower to move the valve body between open and closed positions.

In at least some implementations, the first passage is a fuel and air mixing passage through which a fuel and air mixture is discharged for delivery to an engine, the body defines at least part of a fuel circuit through which fuel is delivered to the first passage and the air bleed passage communicates with the fuel circuit upstream of the first passage to provide air from the air bleed passage into the fuel circuit at least when the control valve is in the second position. The body may define a throttle valve bore, the throttle valve may be generally cylindrical and received within the throttle valve bore for rotation relative to the body about an axis and the first passage may intersect the throttle valve bore, and the throttle valve includes a drive surface at least portions of which are arranged at a varying distance from the axis and the drive surface engages and displaces the control valve during at least a portion of the rotation of the throttle valve. A valve seat may be provided that is engaged by the control valve when the control valve is in the first position, and the control valve may include a projection that extends through the valve seat and is engaged by the drive surface during at least a portion of the rotation of the throttle valve. The valve seat may define an opening and the control valve may engage the valve seat when the control valve is in the first position, and the control valve may include a portion that extends through the opening and said portion of the control valve that extends through the opening is engaged by the drive surface during at least a portion of the rotation of the throttle valve.

BRIEF DESCRIPTION OF THE DRAWINGS

The following detailed description of certain embodiments and best mode will be set forth with reference to the accompanying drawings, in which.

DETAILED DESCRIPTION

Figure 1:
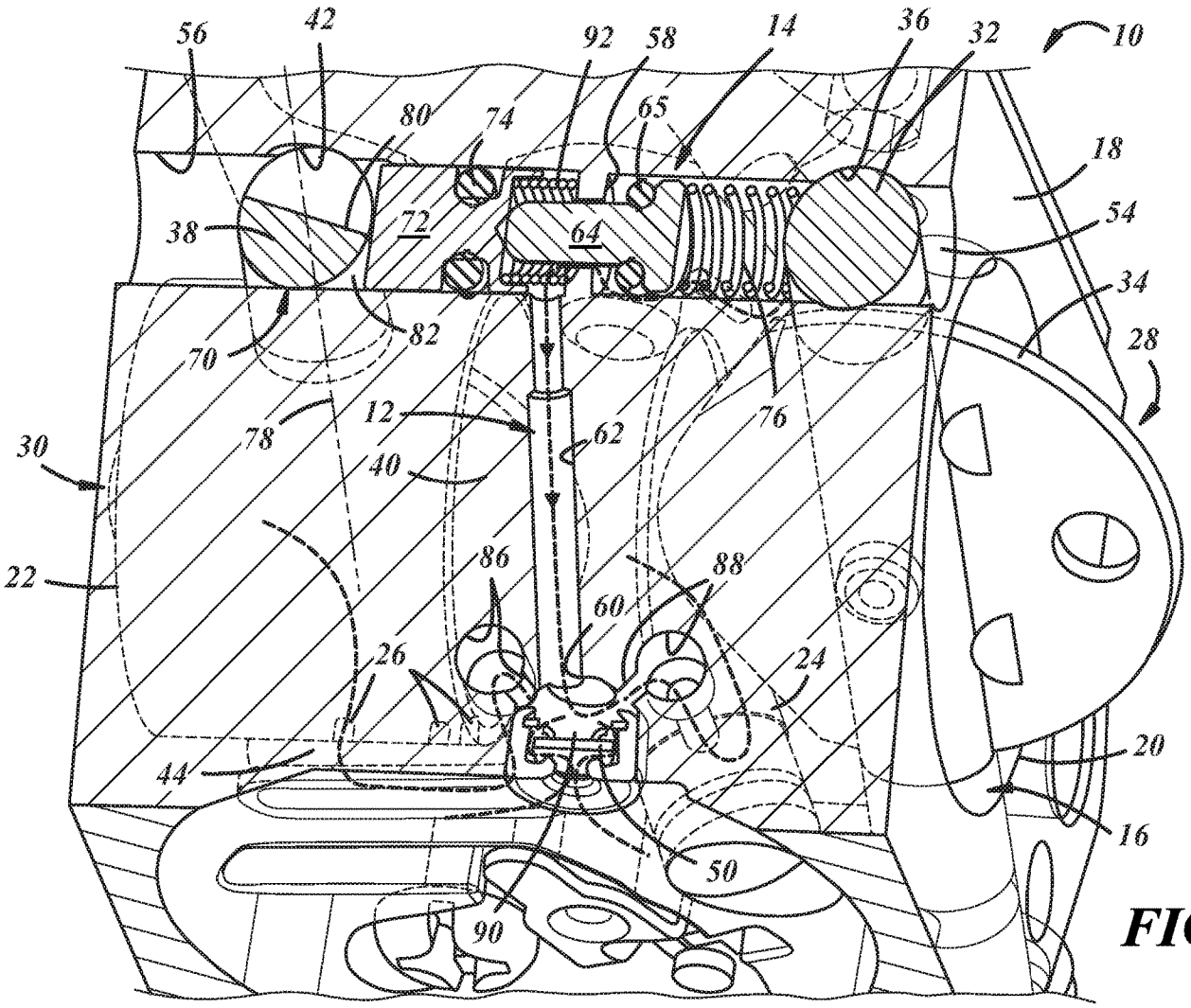
FIG. 1 is a sectional view of a portion of a carburetor with a body shown as transparent and an air bleed control valve in an open position.
Figure 2:
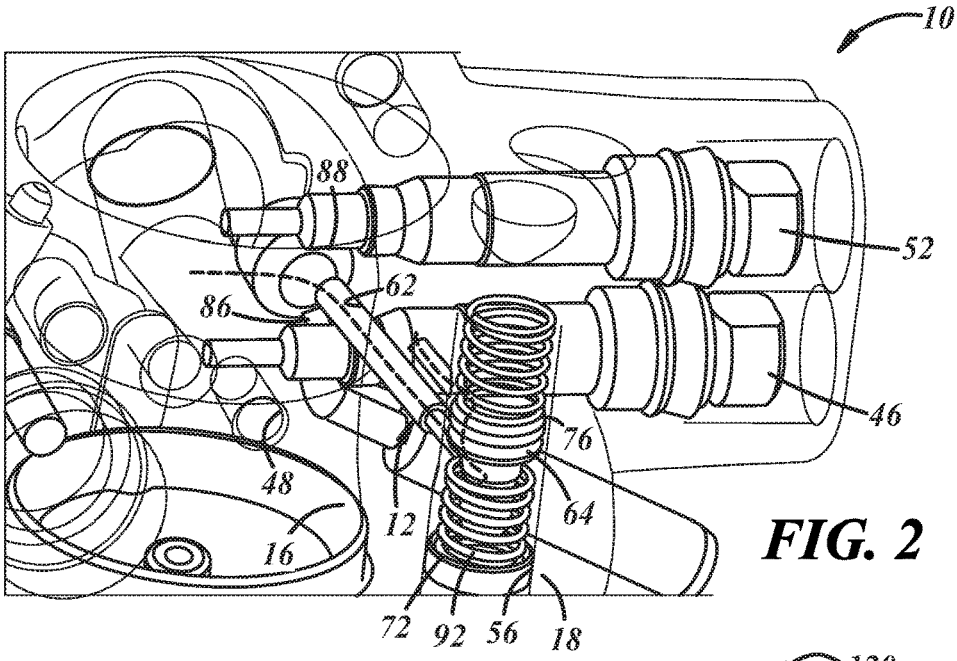
FIG. 2 is a perspective view of a portion of the carburetor of FIG. 1.
Figure 5:
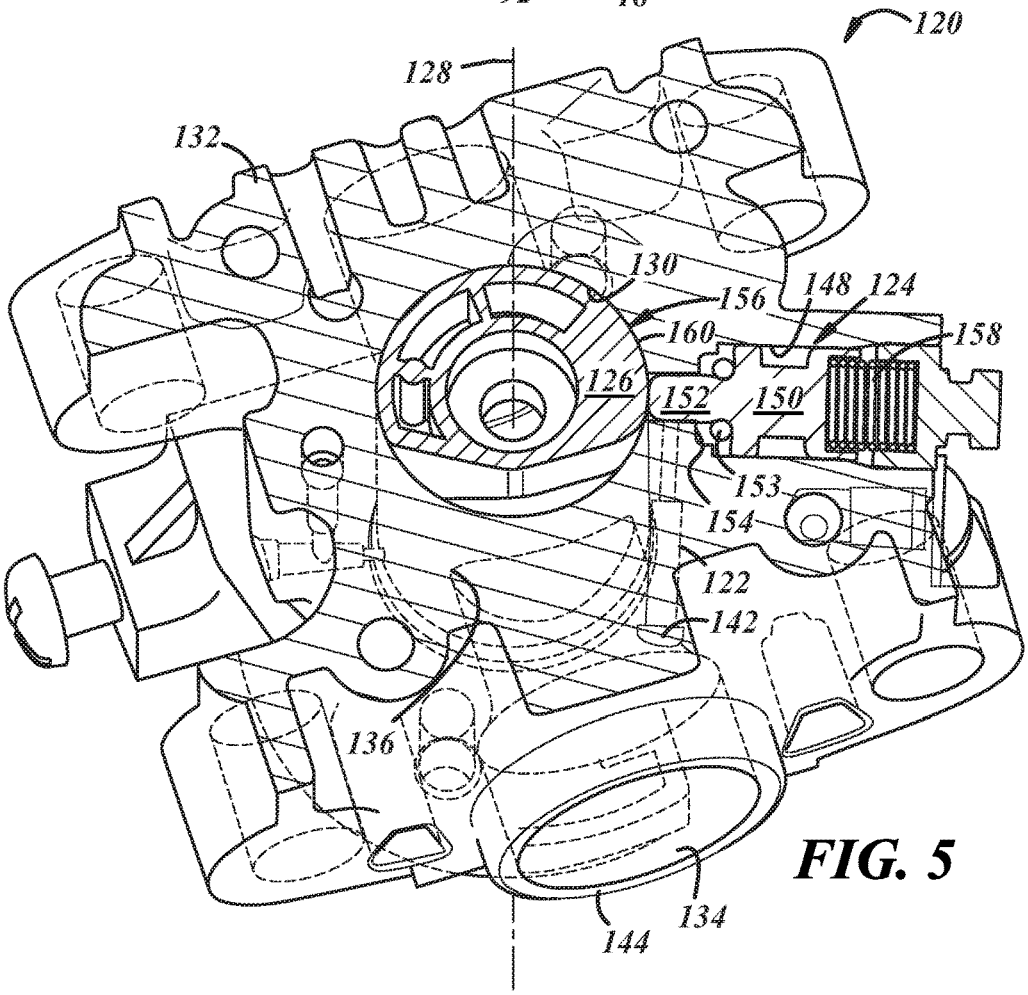
FIG. 5 is a perspective view of a portion of a carburetor with a body shown transparent to show internal passages and components, and with a control valve shown in an open position.
Figure 3:
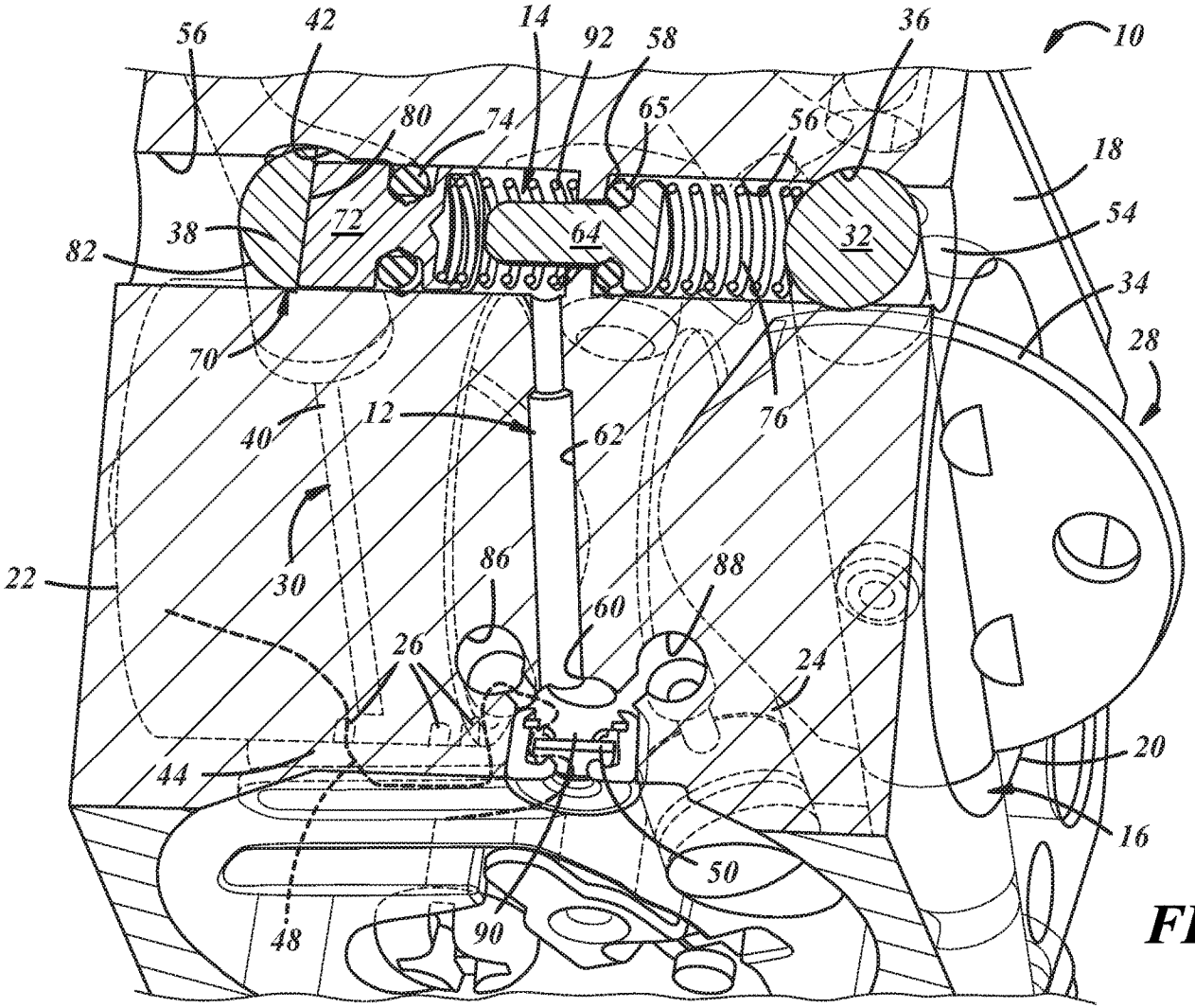
FIG. 3 is a sectional view of the carburetor showing the air bleed control valve in a closed position.

Referring in more detail to the drawings, FIGS. 1-3 illustrate one implementation of a carburetor 10 that provides a charge including a fuel and air mixture to an engine to support operation of the engine and includes a supplemental air supply through which air may be provided into the fuel and air mixture. The flow of supplemental air may be provided in and from an air bleed passage 12 that may include or be associated with a control valve 14 to throttle or selectively inhibit or prevent the supplemental air flow. In at least some implementations, the air bleed passage 12 communicates with a first passage which may be a fuel and air mixing passage 16 that is formed in and extends through a carburetor body 18, and includes an inlet end 20 and an outlet end 22. Fuel is delivered into the mixing passage 16 through a fuel circuit including a fuel supply and a high speed portion with a main nozzle 24, and a low speed portion with one or more low speed or idle ports 26. The fuel is mixed with air flowing through the mixing passage 16 and is delivered to an engine to support combustion in the engine. The fuel circuit may also include or define at least part of a first passage and air from the air bleed may be provided into the fuel circuit, such as in the first passage thereof, prior to the fuel being fed into the fuel and air mixing passage.

To control fluid flow through the mixing passage 16, the carburetor 10 may include a choke valve 28 and a throttle valve 30. The choke valve 28 may be located near the inlet end 20 to control air flow into the mixing passage 16 and may include a valve shaft 32 and a valve head 34 (shown as a thin plate, often called a butterfly type valve) carried by the valve shaft. The valve shaft 32 may be rotatably carried by the carburetor body 18, such as in a bore 36 that extends through the mixing passage 16. The valve head 34 is positioned in or near the mixing passage 16 so that rotation of the valve shaft 32 causes rotation of the valve head 34 between an open position permitting a substantially unrestricted air flow into the mixing passage 16 and a closed position substantially restricting the flow of air into the mixing passage. In this implementation, the choke valve head 34 is a generally flat disc shaped for rotation at least partially within and relative to the mixing passage 16. As is known in the art, a lever (not shown) may be attached to the choke valve shaft 32 to facilitate rotation of the choke valve 28.

The throttle valve 30 may be constructed and arranged like the choke valve 28 with a throttle valve shaft 38 and a valve head 40 (also shown as a thin plate), with the throttle valve shaft 38 rotatably carried by the carburetor body 18, such as in a bore 42 that extends through the mixing passage 16 and which may be parallel to the choke valve shaft bore 36. The throttle valve head 40 may be disposed in the mixing passage 16 and rotatable between an idle position substantially restricting fluid (air and fuel) flow out of the mixing passage outlet end 22 and a wide open position permitting a substantially unrestricted flow out of the outlet end 22. As is known in the art, a lever (not shown) may be attached to the throttle valve shaft 38 to facilitate rotation of the throttle valve 30, such as with a bowden cable and a remotely actuated throttle trigger or other mechanism.

During warm or cold idling conditions of the engine, the throttle valve 30 is in its idle position which is substantially closed, as shown in FIG. 3. This closure greatly restricts air flow through the mixing passage 16 and the running engine produces a large pressure drop downstream of the throttle valve 30 which moves fuel a fuel supply (e.g. a fuel metering chamber defined within the carburetor) through the low speed portion of the carburetor fuel circuit which may include an emulsifying chamber 44 that leads to one or more ports 26 that open into the mixing passage 16 in the area of the throttle valve 30. Prior to discharge of the fuel necessary for engine idling, the fuel first flows into the emulsifying chamber 44, and the rate or quantity of this fuel flow may be controlled, in at least some implementations, by an adjustable low speed needle valve 46 (FIG. 2), which is partially received in a fuel path 48 leading to the emulsifying chamber.

As the throttle valve 30 opens (i.e. rotates away from its idle position), the throttle valve head 40 sweeps past the ports 26, one by one, reducing the air pressure differential or vacuum downstream of the throttle valve 30. This reduces air flow and mixing within the emulsifying chamber 44, and the overall fuel contribution therefrom. At throttle valve positions sufficiently off idle, the primary fuel flow into the fuel and air mixing passage 16 occurs through the high speed fuel circuit that includes the main nozzle 24 which communicates with the fuel supply (e.g. fuel metering chamber) through a check valve 50, fuel passages and an adjustable high speed fuel metering needle valve 52 (FIG. 2). It will be appreciated that the carburetor 10 is not shown in its entirety in FIGS. 1-3, where certain plates, covers or other components are not shown. The carburetor 10 may include a diaphragm fuel pump and a diaphragm type fuel metering assembly, if desired. The general construction and operation of the carburetor 10 may be as disclosed in U.S. Pat. No. 6,374,810 the disclosure of which is incorporated herein by reference in its entirety.

To provide supplemental air into the mixing passage 16 during at least certain operating conditions of the carburetor 10, the air bleed passage 12 may extend between and communicate a supply of air with the mixing passage 16. In at least some implementations, the supply of air may be air flowing through an air filter upstream of the carburetor 10. The air bleed passage 12 may have an inlet end 54 spaced from the mixing passage 16 (if desired) and located adjacent to the inlet end 20 of the mixing passage (e.g. open to the same side of the carburetor body 18) and may intersect the choke valve shaft bore 36 so that air flow through the air bleed passage 12 flows around the choke valve shaft 32. The air bleed passage 12 may include or be defined in part by a bore 56 extending between and intersecting the choke valve shaft bore 36 and the throttle valve shaft bore 42. A valve seat 58 may be provided between the inlet end 54 and an outlet end 60 of the air bleed passage 12 which is open to or leads to the mixing passage 16. The valve seat 58 may also be located in the bore 56 between the choke valve shaft bore 36 and the throttle valve shaft bore 42. In the implementation shown, the air bleed passage 12 includes a branch passage 62 leading from a first portion including part of the bore 56 and a second portion that includes the outlet end 60 of the air bleed passage 12. The outlet end 60 of the air bleed passage 12 is open to or leads to and is communicated with the mixing passage 16 so that air flowing through the outlet end flows into the mixing passage as will be described in more detail later. The arrangement of the air bleed passage 12 shown and described is merely one example and other arrangements may be used.

To control air flow in the air bleed passage 12, the air bleed control valve 14 may be provided within the air bleed passage 12 or otherwise operably associated with the passage. In at least some implementations, the air bleed control valve 14 includes a valve body 64 that is driven by the throttle valve 30 so that the control valve 14 is opened (e.g. not engaged with the valve seat) and closed (engaged with the valve seat) as a function of the throttle valve position. To improve sealing on the valve seat 58, a seal 65 may be provided between the seat and valve body 64 (shown as an o-ring carried by the valve body 64). In the implementation shown in FIGS. 1-3, the control valve 14 is arranged for reciprocation within the air bleed passage 12 between first and second positions. In more detail, the control valve 14 is received within the bore 56 between the valve shaft bores 36, 42 with part of the valve body 64 within the air bleed passage 12 and part of the valve body 64 extending downstream of the valve seat 58 (with respect to the direction of air flow through the air bleed passage) and adjacent to the throttle valve shaft 38. The throttle valve shaft 38 may include or cooperate with a cam or driving surface 70 that causes displacement of the control valve body 64 during at least part of the rotation of the throttle valve 30 between its closed and wide open positions.

In the implementation shown, the control valve 14 includes a follower 72 between the throttle valve shaft 38 and the valve body 64 and engaged with the throttle valve shaft. The follower 72 may include a seal 74 to prevent air leaking into or out of the air bleed passage 12 past the follower. The follower 72 may be engaged with the valve body 64 so that movement of the follower is transmitted to the valve body to move the valve body relative to the valve seat 58. A biasing member 76 may act on the control valve body 64 to yieldably bias the control valve 14 toward the valve seat 58 so that the control valve 64 is closed unless displaced off the seat 58. In the example shown, the biasing member is a spring 76 located between the choke valve shaft 32 and the valve body 64, although other arrangements may be used. The spring 76 also biases the valve body 64 against the follower 72 in at least certain positions of the follower 72.

In at least some implementations, the driving surface 70 is not circular with respect to an axis 78 of rotation of the throttle valve 30 so that the distance of the driving surface 70 from the valve seat 58 changes during at least part of the rotation of the throttle valve 30 between its closed and wide open positions. In the example shown, the driving surface 70 is defined by part an outer surface of the throttle valve shaft 38 which is generally D-shaped with a flat portion 80 and a partially circular portion 82. As shown in FIG. 3, when the flat portion 80 is generally parallel to the valve seat 58, the outer surface of the throttle valve shaft 38 is spaced a greater distance from the valve seat 58 than is the circular portion 82. Hence, in the position shown in FIG. 3, the spring 76 pushes the valve body 64 against the valve seat 58 to inhibit or prevent air flow through the valve seat 58. In this position, the air bleed passage 12 provides little to no supplemental air flow to the mixing passage 16. Conversely, when the throttle valve 30 is rotated to the position shown in FIG. 1, the circular portion 82 of the throttle valve shaft 38 is engaged with the follower 72 and the outer surface of the circular portion 82 is closer to the valve seat 58 (and farther from the axis of rotation 78 of the throttle valve shaft 38 than the flat portion 80) so the follower 72 is pushed toward the valve seat and into the valve body. The valve body 64 is moved off the valve seat 58 by the follower 72 (in this embodiment, the shaft 38 pushes the follower 72 which pushes the valve body 64) to open the control valve 14 and permit supplemental air flow through the valve seat 58.

In at least some implementations, the valve seat defines an opening and the control valve includes a portion that extends through the opening. The portion of the control valve that extends through the opening is engaged by the drive surface 70 during at least a portion of the rotation of the throttle valve. In other words, the control valve engages the valve seat in a first direction and the drive surface 70 moves the control valve in a second direction that is opposite to the first direction. The engagement between the drive surface and control valve is on an opposite side of the valve seat as the engagement between the control valve and the valve seat.

In the implementation shown, the air bleed passage outlet end 60 is communicated with low and high speed needle valves 46, 52 of the carburetor via passages 86, 88 in which the needle valves 46, 52 are received. The needle valves 46, 52 may control fuel flow from a fuel metering assembly and to ports or nozzles in the mixing passage. As shown, the air bleed passage outlet end 60 opens into a pocket 90 into which fuel flows when the check valve 50 at an inlet of the pocket 90 is open. The air from the air bleed passage 12 (when the control valve 14 is open) is mixed with fuel in the pocket 90 and the fuel and air mixture then flows through one or both of the low speed portion of the fuel circuit and the high speed portion of the fuel circuit to be mixed with air flowing through the mixing passage 16 and then delivered from the carburetor 10. The air bleed passage 12 outlet could also flow into the mixing passage 16 directly, or to one or both of the low speed and high speed fuel circuits separately.

In at least some implementations, the control valve 14 is arranged to be closed when the throttle valve 30 is in the idle position and for a desired amount of rotation of the throttle valve off idle, in other words, for a desired amount of opening of the throttle valve 30 off idle and toward the wide open position. In the implementation shown, this is accomplished by providing a lost motion coupling between the follower 72 and the valve body 64. As shown in FIG. 3, when the throttle valve 30 is in the idle position, the follower 72 is spaced from the valve body 64 so that initial movement of the follower 72 caused by initial opening off idle of the throttle valve 30 does not move the valve body 64. The separation of the follower 72 and valve body 64 may be ensured by a biasing member such as a spring 92 acting between the follower 72 and the carburetor body 18 or between the follower 72 and a body carried by the carburetor (e.g. the back side of the valve seat 58 as shown). The amount of space between the follower 72 and the valve body 64 determines the point in the throttle valve opening at which the valve body 64 will be opened and an air bleed flow will be provided to the fuel and air mixture (i.e. the amount that the follower 72 can move relative to the valve body 64 before engaging the valve body 64).

In at least some implementations, the control valve 14 is closed until the throttle valve 30 is opened between 30% and 90% of the movement between idle and wide open positions.

As stated herein, a control valve 14 that is open only at 90% or more of throttle valve movement off idle represents a situation where the valve 14 is opened only when the throttle valve 30 is nearly in the wide open position and up to and including the wide open position (so the final 10% of throttle valve movement to wide open). And a control valve 14 that is opened at 30% of throttle valve movement off idle is opened when the throttle valve 30 has rotated less than ⅓ of the way toward the wide open position. Hence, air from the air bleed is not supplied to the fuel and air mixture when the throttle valve 30 is at idle and, in at least some implementations, until the throttle valve 30 is opened sufficiently off idle. This permits a relatively richer fuel and air mixture to be delivered to the engine to facilitate starting and warming up of the engine, can improve idle engine operation, and can support engine acceleration off idle. The supply of air from the air bleed passage 12 when the control valve 14 is opened provides a leaner fuel and air mixture to the engine (than if the valve was closed) at higher engine speeds or when the engine is under higher loads (e.g. when the throttle valve is sufficiently off idle) which may better support such engine operation (e.g. increased engine power) and may provide better comedown engine operation from wide open throttle back to or toward idle (deceleration). The noted lost motion coupling is just one example, other couplings can be needed. Further, the follower 72 is not needed and the throttle valve 30 could directly drive the valve body 64 if desired. Any lost motion coupling desired in such an arrangement would occur between the throttle valve 30 and the valve body 64.

Figure 4:
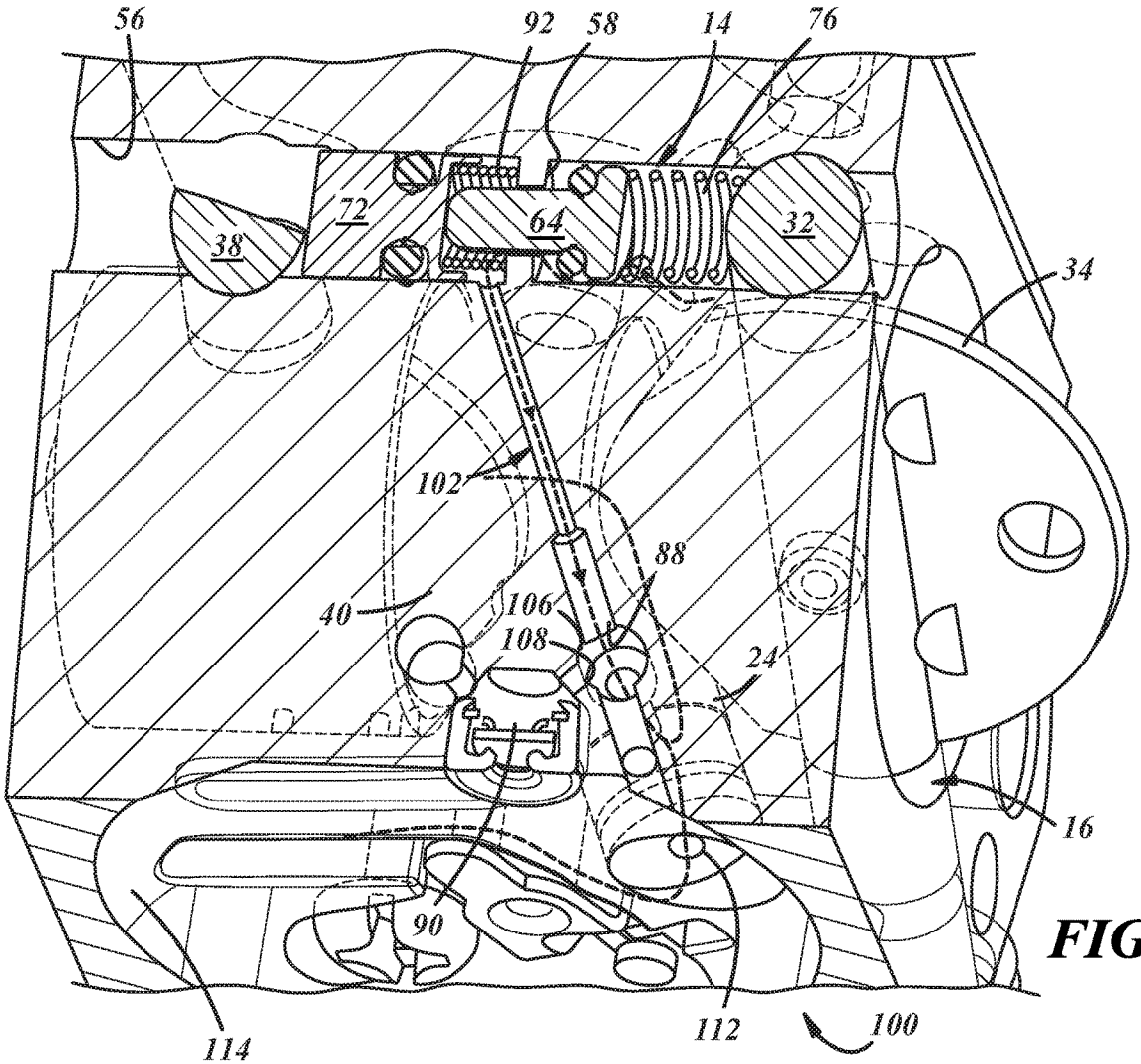
FIG. 4 is a sectional view of a carburetor showing an air bleed control valve in an open position.
Figure 6:
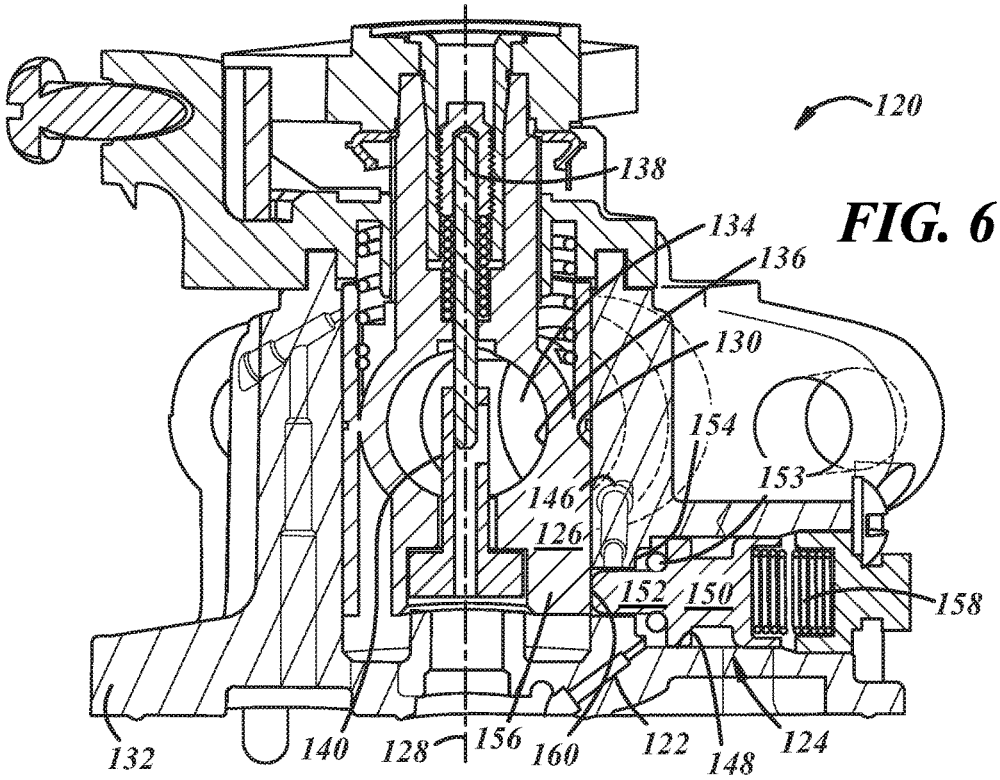
FIG. 6 is a sectional view of a portion of the carburetor of FIG. 5 showing the control valve in the open position.

FIG. 4 illustrates another implementation of a carburetor 100 including an air bleed passage 102. The air bleed passage 102 and control valve 14 may be arranged substantially as described above. However, in this version, an air bleed passage outlet 106 leads directly to one of the passages 108 in which a needle valve is received and not to the pocket 90, so the air supplied from the bleed passage 102 is only provided into one of the low speed or high speed fuel circuits. As shown, the air bleed passage outlet 106 leads to the high speed needle valve passage 108 which is arranged in the high speed fuel circuit. While a valve like high speed needle valve (which may be constructed and arranged as shown in the embodiment shown in FIGS. 1-3) normally meters fuel flow in and to the high speed fuel circuit, in this implementation, the high speed needle valve in a passage 108 only meters the air flow from the air bleed passage 102 as the high speed needle valve passage 108 is not open to the pocket 90. Instead, the high speed fuel circuit includes a fuel metering nozzle 112 that meters fuel flowing from the fuel supply in the carburetor 100 (e.g. a fuel metering chamber 114 which maybe of conventional construction) and the air bleed passage 102 provides air into that fuel flow (either upstream or downstream of the nozzle) which is then provided into the mixing passage 16.

The metering by the needle valve in passage 108 of the supplemental air supplied from the air bleed passage 102 permits greater control of the flow rate of air provided for more reliable and consistent control of the fuel and air mixture provided from the carburetor 100. Of course, a different valve could meter the air flow if desired, and the high speed needle valve could be used to meter fuel as it normally would, if desired. Hence, the air bleed in this implementation includes a first valve (e.g. control valve 14) that selectively prevents air flow therethrough and a second valve (e.g. needle valve 108) that is always open and meters air flow therethrough. In the implementation shown, the second valve is downstream of the first valve, although that is not necessary.

FIGS. 5-8 illustrate a rotary throttle valve carburetor 120 that includes an air bleed passage 122 and a control valve 124 arranged to achieve similar functionality as the air bleed passage 12 and control valve 14 described above. The general construction and operation of the rotary throttle valve carburetor 120 may be as disclosed in U.S. Pat. No. 7,287,741 the disclosure of which is incorporated herein by reference in its entirety. In general, the carburetor 120 includes a generally cylindrical throttle valve 126 (also shown in FIG. 9) that rotates between idle and wide open positions about an axis 128 and within a bore 130 in a main body 132 of the carburetor 120. A fuel and air mixing passage 134 intersects the throttle valve bore 130 and the throttle valve 126 includes an opening 136 that is aligned with the mixing passage 134 to a varying degree as the throttle valve 126 is rotated (where the opening 136 is less aligned with the mixing passage 134 in the idle position of the throttle valve 126 than in the wide open position). A cam axially displaces the throttle valve 126 as it rotates to axially move a needle 138 (FIGS. 6 and 8) fixed to the throttle valve 126 relative to a fuel nozzle 140 (FIGS. 6 and 8, removed/not shown in FIGS. 5 and 7) carried by the carburetor body 132. Hence, the flow area of the fuel nozzle 140 changes as the axial position of the throttle valve 126 changes to thereby control the flow rate of fuel out of the fuel nozzle 140 and into a fuel and air mixing passage 134. In this way, rotation of the throttle valve 126 controls both air and fuel flow to the mixing passage 134.

In the implementation shown, an air bleed passage inlet 142 is open to the inlet side 144 of the carburetor body 132 and receives air from an air filter that is adjacent to the carburetor 120. An outlet 146 of the air bleed passage 122 is open to or communicated with the mixing passage 134. In the implementation shown, the air bleed passage 122 extends through a cavity 148 in which the control valve 124 is received, and is open to the throttle valve bore 130 where air provided into the throttle valve bore 130 may flow into the mixing passage 134, such as with fuel flowing through the fuel nozzle 140 or downstream of the fuel nozzle, as desired. The air bleed passage 122 may take any desired route between the inlet 142 and outlet 146, including passages formed within the carburetor body or tubing routed externally of the carburetor body or a combination of the two, as desired. Air flows from the inlet 142 to the outlet 146 and is selectively provided to the fuel and air mixing passage 134 (or some other portion of the fuel or air flow in the carburetor) when the control valve 124 is open.

Figure 7:
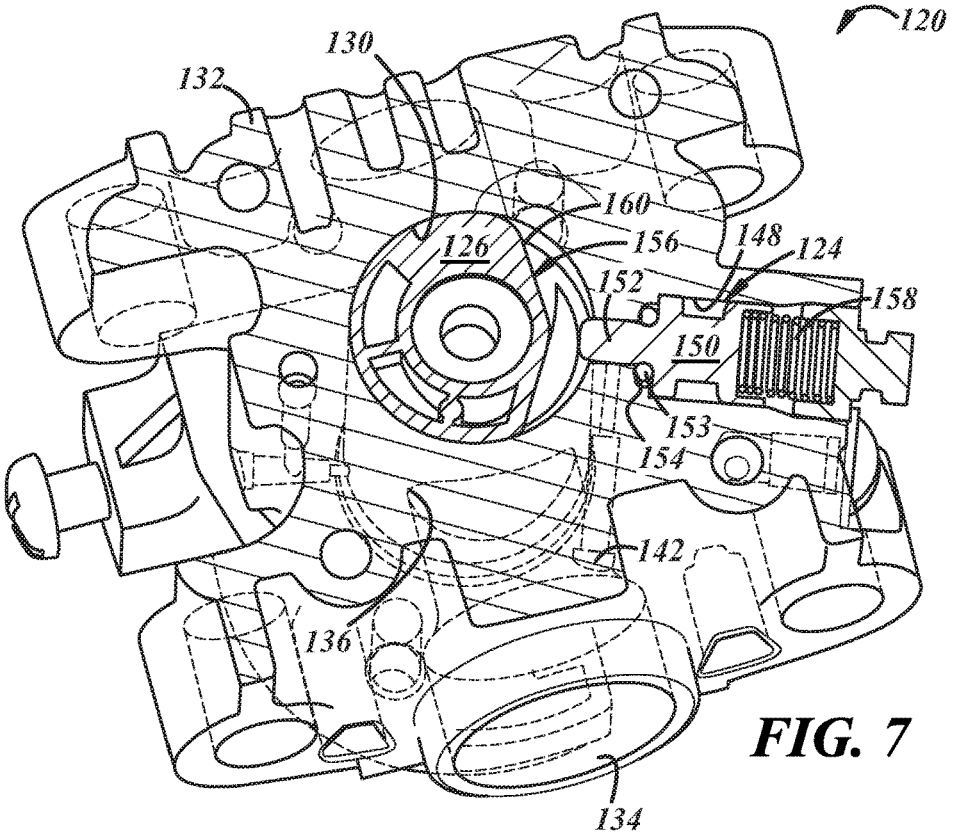
FIG. 7 is a perspective view of a portion of the carburetor with a body shown transparent to show internal passages and components, and with the control valve shown in a closed position.
Figure 8:
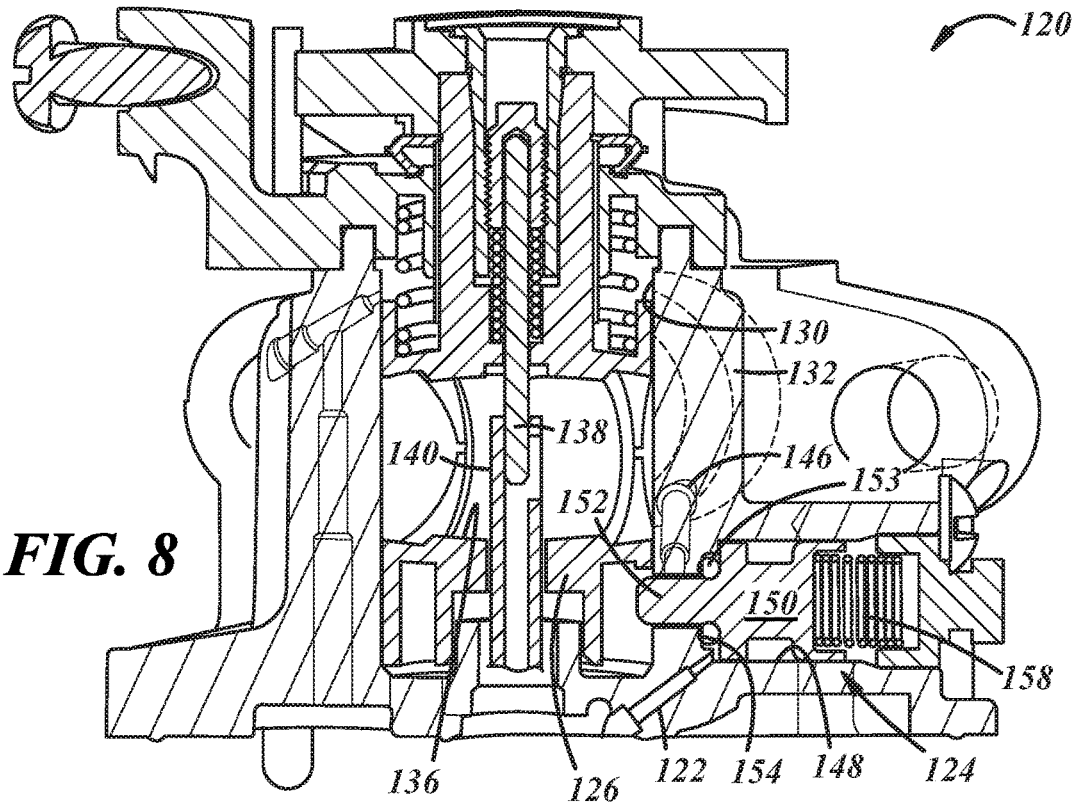
FIG. 8 is a sectional view of a portion of the carburetor showing the control valve in the closed position.
Figure 9:
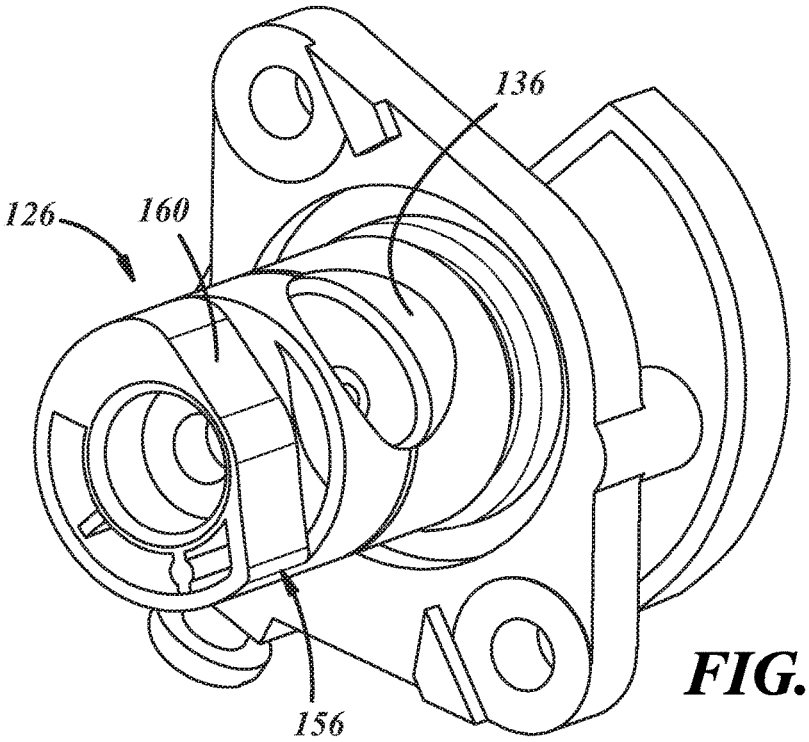
FIG. 9 is a perspective view of a throttle valve that may be used in the carburetor shown in FIGS. 5-8.

The control valve 124 includes a body 150 that is received within the cavity 148 for reciprocation between a first or open position (FIGS. 5 and 6) and a second or closed position (FIGS. 7 and 8). The control valve body 150 may include a portion that is engageable with the throttle valve 126 during at least part of the rotation of the throttle valve between the idle and wide open positions. In the implementation shown, the control valve 124 includes a projection 152 that extends through a valve seat 154 against which a portion of the valve body 150 (or a seal 153 that may be carried by the body 150) is engaged when the control valve 124 is closed. The valve body 150 is yieldably biased, such as by a spring 158 or other biasing mechanism, toward the valve seat 154 so that the valve is closed unless acted on by the cam portion 156. The cam portion 156 includes a drive surface 160 portions of which are arranged at a varying distance from the valve seat 154 along its circumferential extent (in other words, the drive surface is radially contoured, relative to the axis of rotation 128 of the throttle valve 126). Thus, upon rotation of the throttle valve 126, different portions of the cam portion 156 are rotated into alignment with the valve body 150 and the valve body 150 is responsive to at least some of the changes in the radial dimension of the drive surface 160 to move the valve body 150 relative to the valve seat 154 during at least a portion of the rotation of the throttle valve 126.

As in the previous embodiments, the valve body 150 and throttle valve cam portion 156 may be arranged to open the control valve 124 at between 30% to 90% of the throttle valve rotation off idle and toward wide open. Hence, the control valve 124 may be closed when the throttle valve 126 is at idle (as shown in FIGS. 7 and 8) and for some initial rotation off idle. Here, a lost motion coupling may be provided between the valve body 150 and throttle valve 126 by providing clearance (i.e. a gap created by a recess or non-circular portion of the cam portion 156) between them until it is desired to start opening the control valve 124, or by a suitable cam profile on the throttle valve cam portion 156 that does not displace the valve body 150 from the valve seat 154 until a desired amount of throttle valve rotation. While shown as opening the control valve 124 once per rotation from idle to wide open and holding it open for the remainder of the throttle valve rotation to or toward its wide open position, the cam 156 could be arranged to open and close the control valve 124 more than once during a throttle valve rotation, if desired. Further, the amount that the control valve 124 is opened (e.g. the extent of a flow gap around the valve, such as through the valve seat or around the projection) can be controlled for a given position of the throttle valve 126 by providing the cam profile with a desired shape. This may be done to meter the air flow through the valve seat 154 as a function of the throttle valve position, as desired. In other words, the flow gap at the control valve 124 and/or the flow rate of air provided out of the air bleed passage 122 can be controlled, if desired.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A charge forming device, comprising:

a body defining at least part of a first passage through which fuel or air or both flows for delivery to an engine;

a throttle valve movable relative to the first passage between an idle position and a wide open position;

an air bleed passage communicated with the first passage to provide a supply of air to the first passage; and a control valve arranged in the air bleed passage to selectively inhibit or prevent air flow to the first passage from the air bleed passage, the control valve being moveable between a first position and a second position in response to movement of the throttle valve wherein greater air flow is permitted from the air bleed passage to the first passage in the body when the control valve is in the second position than when the control valve is in the first position, and wherein the throttle valve includes or cooperates with a driving surface that, during at least a portion of the movement of the throttle valve between the idle position and the wide open position, causes displacement of the control valve.

2. The device of claim 1 wherein the control valve is driven by the throttle valve between its first and second positions.

3. The device of claim 1 wherein a lost motion coupling is provided between the throttle valve and the control valve, and wherein the control valve is in the first position when the throttle valve is in the idle position and until the throttle valve is moved a threshold amount toward the wide open position.

4. The device of claim 3 wherein the threshold amount is between 30% and 90%.

5. The device of claim 1 wherein the first passage is a fuel and air mixing passage through which a fuel and air mixture is discharged for delivery to an engine, the body defines at least part of a fuel circuit through which fuel is delivered to the first passage and the air bleed passage communicates with the fuel circuit upstream of the first passage to provide air from the air bleed passage into the fuel circuit at least when the control valve is in the second position.

6. The device of claim 1 wherein the body defines a throttle valve bore, the throttle valve is generally cylindrical and received within the throttle valve bore for rotation relative to the body about an axis and the first passage intersects the throttle valve bore, and wherein at least portions of the drive surface are arranged at a varying distance from the axis and the drive surface engages and displaces the control valve during at least a portion of the rotation of the throttle valve.

7. The device of claim 6 which also includes a valve seat engaged by the control valve when the control valve is in the first position, and wherein the control valve includes a projection that extends through the valve seat and is engaged by the drive surface during at least a portion of the rotation of the throttle valve.

8. The device of claim 1 wherein the control valve includes a follower that is engaged by the driving surface.

9. The device of claim 1 wherein the throttle valve includes a cam portion that includes the drive surface.

10. The device of claim 1 wherein the throttle valve rotates about an axis and the drive surface is not circular relative to the axis.

11. The device of claim 1 wherein the throttle valve includes a throttle valve shaft the drive surface is defined by an outer surface of the throttle valve shaft.

12. A charge forming device, comprising:

a body defining at least part of a first passage through which fuel or air or both flows for delivery to an engine;

a throttle valve movable relative to the first passage between an idle position and a wide open position;

an air bleed passage communicated with the first passage to provide a supply of air to the first passage; and a control valve arranged in the air bleed passage to selectively inhibit or prevent air flow to the first passage from the air bleed passage, the control valve being moveable between a first position and a second position in response to movement of the throttle valve wherein greater air flow is permitted from the air bleed passage to the first passage in the body when the control valve is in the second position than when the control valve is in the first position, wherein the control valve is driven by the throttle valve between its first and second positions, and which also includes a valve seat against which the control valve is engaged in the first position, and wherein the throttle valve includes a cam portion that has a distance from the valve seat that varies as the throttle valve is moved between the idle position and wide open position.

13. A charge forming device, comprising:

a body defining at least part of a first passage through which fuel or air or both flows for delivery to an engine;

a throttle valve movable relative to the first passage between an idle position and a wide open position;

an air bleed passage communicated with the first passage to provide a supply of air to the first passage; and a control valve arranged in the air bleed passage to selectively inhibit or prevent air flow to the first passage from the air bleed passage, the control valve being moveable between a first position and a second position in response to movement of the throttle valve wherein greater air flow is permitted from the air bleed passage to the first passage in the body when the control valve is in the second position than when the control valve is in the first position, wherein the throttle valve is rotatable about an axis between the idle position and wide open position, and wherein the throttle valve includes a drive surface that is not circular relative to the axis and the drive surface causes movement of the control valve between the first and second positions as the throttle valve is rotated.

14. The device of claim 13 wherein a lost motion coupling is provided between the throttle valve and the control valve so that some rotation of the throttle valve occurs without a corresponding movement of the control valve.

15. The device of claim 13 wherein the first passage is a fuel and air mixing passage through which a fuel and air mixture is discharged for delivery to an engine, the body includes a valve shaft bore that intersects the fuel and air mixing passage and the throttle valve includes a throttle valve shaft received for rotation about the axis within the valve shaft bore and a throttle valve head carried by the throttle valve shaft and wherein the drive surface is carried by or formed on the throttle valve shaft.

16. The device of claim 15 wherein part of the air bleed passage intersects the valve shaft bore and the control valve is received within said part of the air bleed passage.

17. The device of claim 16 wherein the control valve includes a follower and a valve body that are received in said part of the air bleed passage that intersects the valve shaft bore, the follower being engaged by and moved within the air bleed passage by the drive surface during a portion of the rotation of the throttle valve shaft and the follower engaging the valve body during at least a portion of the movement of the follower to move the valve body between open and closed positions.

18. The device of claim 13 which also includes a valve seat defining an opening and wherein the control valve engages the valve seat when the control valve is in the first position, and wherein the control valve includes a portion that extends through the opening and said portion of the control valve that extends through the opening is engaged by the drive surface during at least a portion of the rotation of the throttle valve.

* * * * *